United States Patent [19]

Ford et al.

[11] 4,116,758

[45] Sep. 26, 1978

[54] METHOD OF PRODUCING HIGH YIELD CHEMIMECHANICAL PULPS

[75] Inventors: Michael J. Ford, West Hawkesbury; Prescott Elliott Gardner, Vankleek Hill, both of Canada

[73] Assignee: Canadian International Paper Co., Montreal, Canada

[21] Appl. No.: 838,837

[22] Filed: Oct. 3, 1977

Related U.S. Application Data

[63] Continuation of Ser. No. 687,454, May 18, 1976, abandoned.

[30] Foreign Application Priority Data

May 14, 1976 [CA] Canada ..... 252642

[51] Int. Cl.[2] ..... D21C 3/06; D21C 3/12; D21C 3/26

[52] U.S. Cl. ..... 162/28; 162/38; 162/56; 162/61; 162/71; 162/83; 162/84; 162/86

[58] Field of Search ..... 162/28, 38, 56, 61, 162/71, 83, 84, 86

[56] References Cited

U.S. PATENT DOCUMENTS

| | | | |
|---|---|---|---|
| 1,821,198 | 9/1931 | Zimmerman | 162/83 X |
| 1,859,847 | 5/1938 | Rue | 162/83 |
| 2,847,304 | 8/1958 | Rasch | 162/28 |
| 2,893,909 | 7/1959 | Shouvlin et al. | 162/17 |
| 2,949,395 | 8/1960 | Von Hazmburg | 162/84 |
| 2,962,412 | 11/1960 | Richardson | 162/61 |
| 3,003,909 | 10/1961 | Olson | 162/83 X |
| 3,013,931 | 12/1961 | Wethern et al. | 162/83 X |
| 3,013,934 | 12/1961 | Aitken et al. | 162/83 |
| 3,078,208 | 2/1963 | Cederquist | 162/83 X |
| 3,446,699 | 5/1969 | Asplund et al. | 162/19 |
| 3,558,428 | 1/1971 | Asplund et al. | 162/19 |
| 3,597,310 | 8/1971 | Sumi et al. | 162/86 X |
| 3,607,618 | 9/1971 | Uschmann et al. | 162/17 |
| 3,741,005 | 6/1973 | Dauth et al. | 73/95 |

OTHER PUBLICATIONS

Richardson, "Ultra High Yield NSCM Pulping", TAPPI, vol. 45, No. 12, 1a-p962, pp.139A-142A.

Mitchell et al., "Role of Base in Sulfite Pulping", PPMC, 3-1936, pp. 195-198 & 209; 162-183.

Richardson et al., "Supergroundwood from Aspen", TAPPI, vol. 48, No. 6, pp. 344-346 (1965).

Chidester et al., "Chemiechemical Pulps from Various Softwoods & Hardwoods", TAPPI, vol. 43, No. 10, pp. 876-880 (1960).

Tappi Standard -T227 (M-58).

Van Deweer, "Unique New Continuous Digesters Improve Operations at Two Mills", Paper Trade Journal, pp. 36-37, 9-5-1960.

Brown, "High Yield Semichemical Pulps From Aspen & Balsam Fir for Printing Paper Production", USDA, Forest Service, Forest Production Laboratories, Project No. 50-7-298 (1958).

"Sophisticated Pilot Pulping Plant Built by CIP in Canada", Pulp & Paper International, pp. 55-56, 5-1971.

Hoglund et al., "Modified Thermomechanical Pulp", Svensk Papperstiding, Nr. 11, 1976, pp. 343-347 & 353.

*Primary Examiner*—Arthur L. Corbin

[57] ABSTRACT

A process for producing high yield chemimechanical pulps from woody lignocellulosic material, such as wood chips, whereby the material is treated with an aqueous solution of a mixture of sulfite and bisulfite, said solution being of sufficient strength to sulfonate said material to at least about 85% of the maximum level of sulfonation that can be achieved on said material without reducing the pulp yield to below 90% and subjecting the resulting sulfonated material to mechanical defibration.

11 Claims, 12 Drawing Figures

Figure 1A:
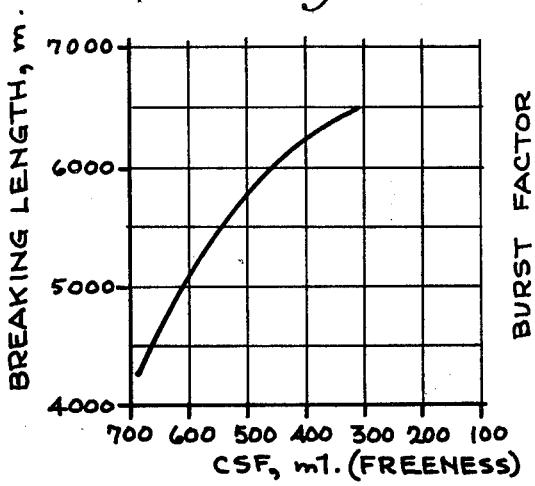

THE EFFECT OF FREENESS ON THE STRENGTH PROPERTIES OF A PULP MADE AS IN EXAMPLE 1.

METHOD OF PRODUCING HIGH YIELD CHEMIMECHANICAL PULPS

This is a continuation of application Ser. No. 687,454, filed May 18, 1976, now abandoned.

BACKGROUND OF THE INVENTION

This invention relates to the production of chemimechanical pulps from wood or other lignocellulosic materials, such as chips, shavings and sawdust, with ultra high yields and with improved strength properties. More particularly, this invention relates to the production of such pulps by means of the sulfonation of the lignin in the wood, using aqueous sulfite or bisulfite solutions, followed by mechanical defibering.

The pulp and paper and related industries use many processes to produce pulp from wood chips and other lignocellulosic materials. These processes can be classified, the purposes of discussion, into four groups, shown below with the representative yields:

Chemical Pulps — up to 60% yield
Semichemical Pulps — 60–80% yield
Chemimechanical Pulps — 80–95% yield
Mechanical Pulps — at least 90% yield The yield ranges shown are approximate only.

Chemical pulps are prepared by cooking the wood chips (or other lignocellulosic material) at elevated temperatures and pressures with various chemical agents which dissolve the lignin and some carbohydrate material to leave relatively pure cellulose fibers at the 40–45% yield level or cellulose plus some residual lignin at somewhat higher yield levels (45–55%).

Mechanical pulps at the other extreme use mechanical means such as grindstones to defiber logs or disc refiners to defiber wood chips into pulp. These processes use water for cooling and dilution purposes so that the appoximately 5% of the wood substance that is water soluble is lost for a net yield of about 95%.

Chemical pulps have many advantages due to their cleanliness, high strength, and ease of bleaching, but they are expensive to produce due to the low yield. Their dissolved solid and gaseous waste products give rise to many environmental problems.

Mechanical pulps are much cheaper to produce due to their high yield and constitute an efficient use of forest resources. Such processes offer no gaseous pollution and relatively little $BOD_5$ (biochemical oxygen demand, 5-day test) discharge compared to chemical pulps.

The semichemical and chemimechanical pulping processes fall midway between the chemical and mechanical processes in these respects.

The increasing world-wide demands for pulp, paper and other forest resource based products are creating an increasing need for the use of higher yield pulps due to the decreasing availability of fiber. The present invention produces a high yield pulp that can replace some types of chemical or semichemical pulp in many products.

It is known that the treatment of wood chips with relatively small amounts of sulphite and bisulphite, at near neutral pH, and under relatively mild conditions (100°–150° C., for 2–15 minutes) produces a softening effect on the chips which makes them easier to defiber and generally produces a cleaner and better draining pulp than can be produced by mechanical means alone. See "Ultrahigh Yield NSCM Pulping", by C. A. Richardson, *Tappi,* Vol. 45, No. 12, pp. 139A–142A (1962); Richardson et al., "Supergroundwood from Aspen", *Tappi,* Vol. 48, No. 6, pp. 344–346 (1965); Chidester et al. "Chemimechanical Pulps from Various Softwoods and Hardwoods", *Tappi,* Vol. 43, No. 10, pp. 876–880 (1960); Uschmann U.S. Pat. No. 3,607,618; Aitken et al. U.S. Pat. No. 3,013,934; and Asplund et al. U.S. Pat. No. 3,558,428.

However, the pulps produced by such processes, while being superior to conventional mechanical pulps in terms of cleanliness and drainage properties, do not have sufficiently good physical properties to justify their increased cost of production relative to the conventional mechanical pulps.

Better properties can be achieved by cooking under more severe conditions such as increased temperatures in the 160°–240° C. range, but the strength improvement is always accompanied by a loss in yield. Instead of yields of over 90%, the yields are reduced to about 70–85%. See most of the above publications and patents and Richardson U.S. Pat. No. 2,962,412; Zimmerman U.S. Pat. No. 1,821,198; Cederquist U.S. Pat. No. 3,078,208; Asplund et al. U.S. Pat. No. 3,446,699; Von Hamzburg U.S. Pat. No. 2,949,395; Olson U.S. Pat. No. 3,003,909; and Risch et al. U.S. Pat. No. 2,847,304.

Considerations of cost and environmental protection make the maintenance of yields in excess of 90% highly desirable.

It is well known that the physical properties of wood pulps are strongly influenced by the flexibility of the individual fibers--which flexibility permits the fibers to be brought into closer contact with each other during the pressing stages of the paper-making process, which in turn leads to better bonding and improved strength. Natural wood fibers are rendered relatively inflexible by the presence of large amounts (20–30% by weight) of lignin which is a relatively rigid material at moderate temperatures (less than 100° C.). Fiber flexibility is improved in conventional chemical or semichemical pulping processes by removing, chemically, at least part and in some cases nearly all of the lignin.

The present invention modifies the lignin by sulfonating it sufficiently to produce a marked change in the physical and chemical properties of the lignin, but not enough to render it soluble in water or in the cooking liquor, so it is not substantially removed from the wood fiber, and yields are consistent with those of purely mechanical pulps (90–95%).

Many softwood species such as spruce can be sulfonated up to about 0.65% (expressed as combined sulfur on wood and measured by the test method, below), usually without reducing the yield below 90%. Conventional high yield chemimechanical pulping processes such as those reported by the Richardson and Chidester et al. publications and Asplund et al. patent, supra, achieve a level of about 0.3 to 0.35% sulfur (on spruce) or only about 50% of the maximum level of sulfonation that can be reached without reducing the yield below about 90% (see comparative prior art Example 9 below). This low level of sulfonation achieves some softening of the lignin, which permits the chips to be more readily defibered than untreated chips, but the individual fibers so produced are still relatively stiff and do not give strong pulps. The stiffness of the fibers also makes them prone to damage (cutting) in the refining stages and the consequent production of fines and debris—although not to the same extent as untreated fibers.

It is, accordingly, an object of the present invention to provide a high yield chemimechanical process for producing pulp from wood chips and other lignocellulosic materials, including shavings and sawdust.

It is another object of the invention to provide a process for producing high yield chemimechanical pulp from wood chips whereby the chips are sulfonated to a high degree of sulfonation and thereafter readily defibered by customary mechanical means to provide a pulp having excellent strength characteristics.

Figure 1B:
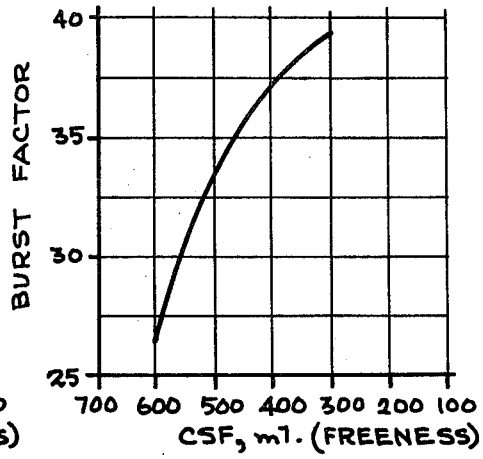
Figure 1C:
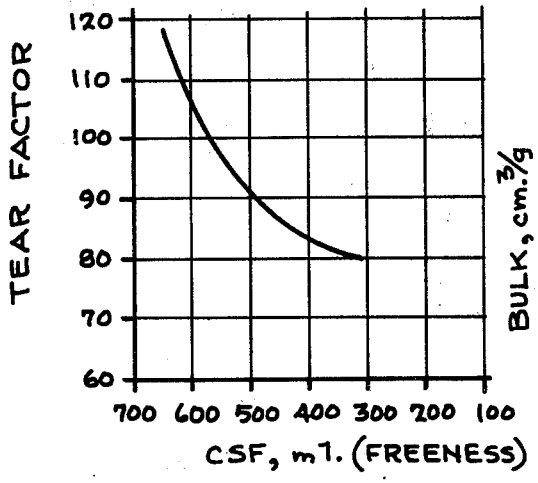
Figure 1D:
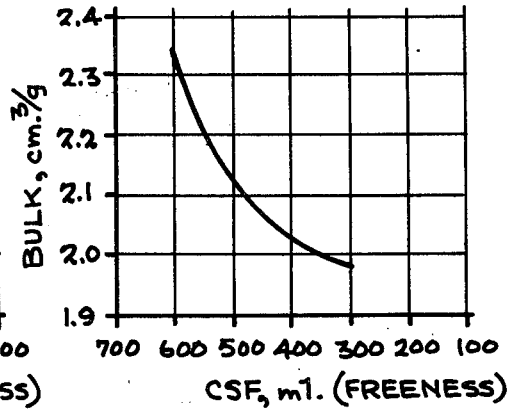
Figure 1E:
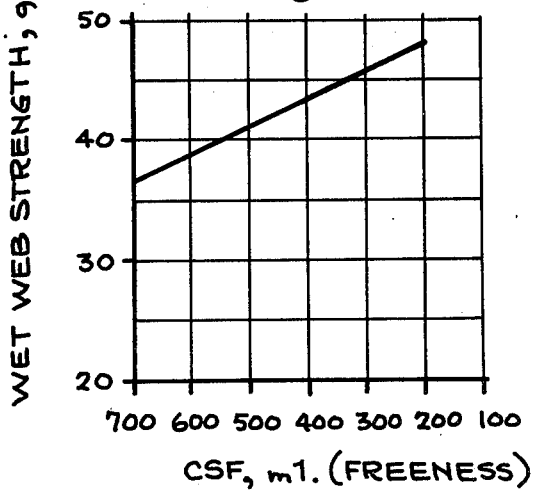

Other objects will be apparent to those skilled in the art from the present description, taken in conjunction with the appended drawings, in which:

FIGS. 1*a* and 1*e* are a series of five graphs where five physical properties of pulps produced in accordance with Examples 1 and 2, infra, are plotted against freeness (CSF, ml.). These properties are breaking length (FIG. 1*a*), factor (FIG. 1*b*), tear factor (FIG. 1*c*), bulk (FIG. 1*d*) and wet web strength (FIG. 1*e*).

Figure 2:
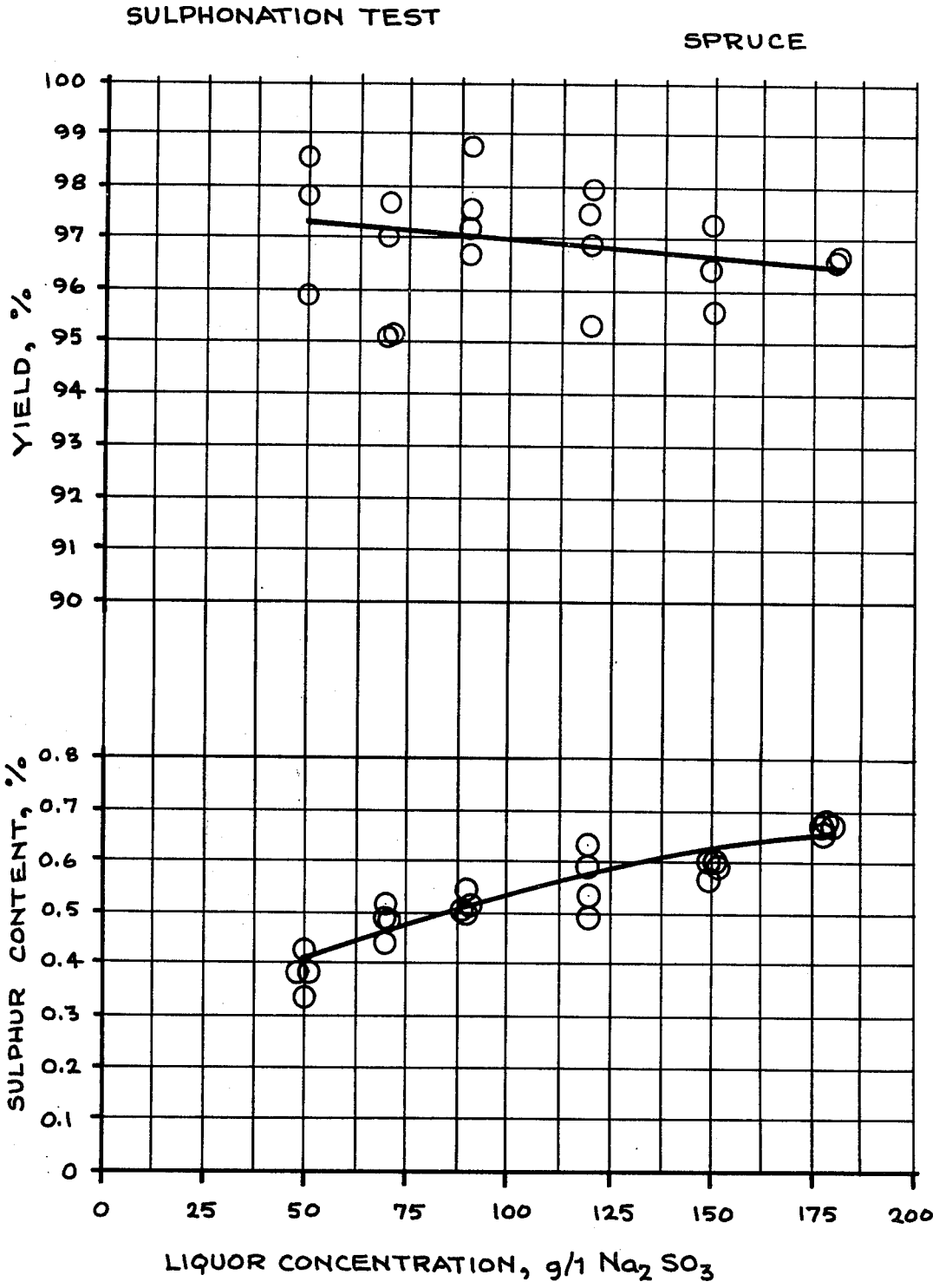
Figure 3:
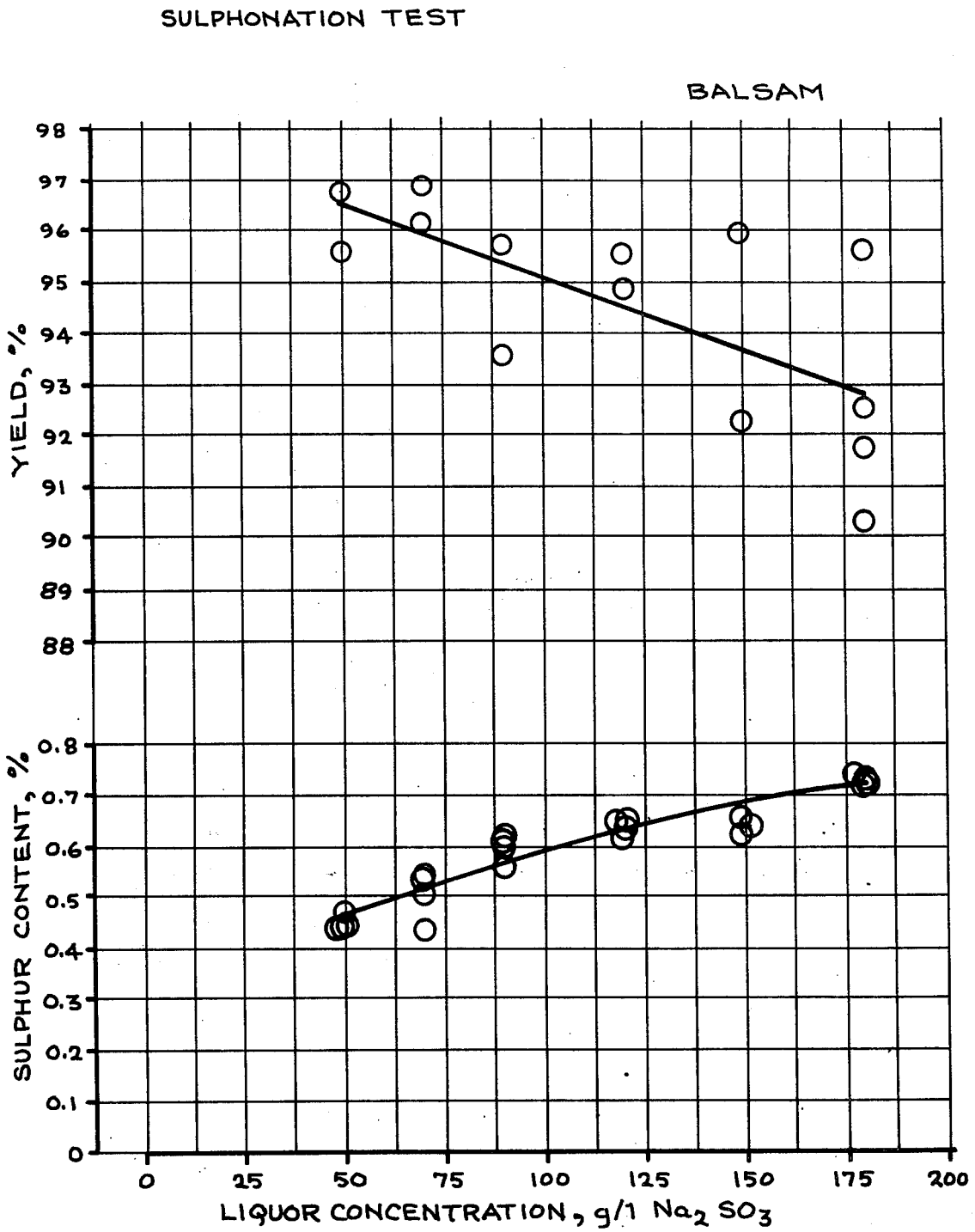
Figure 4:
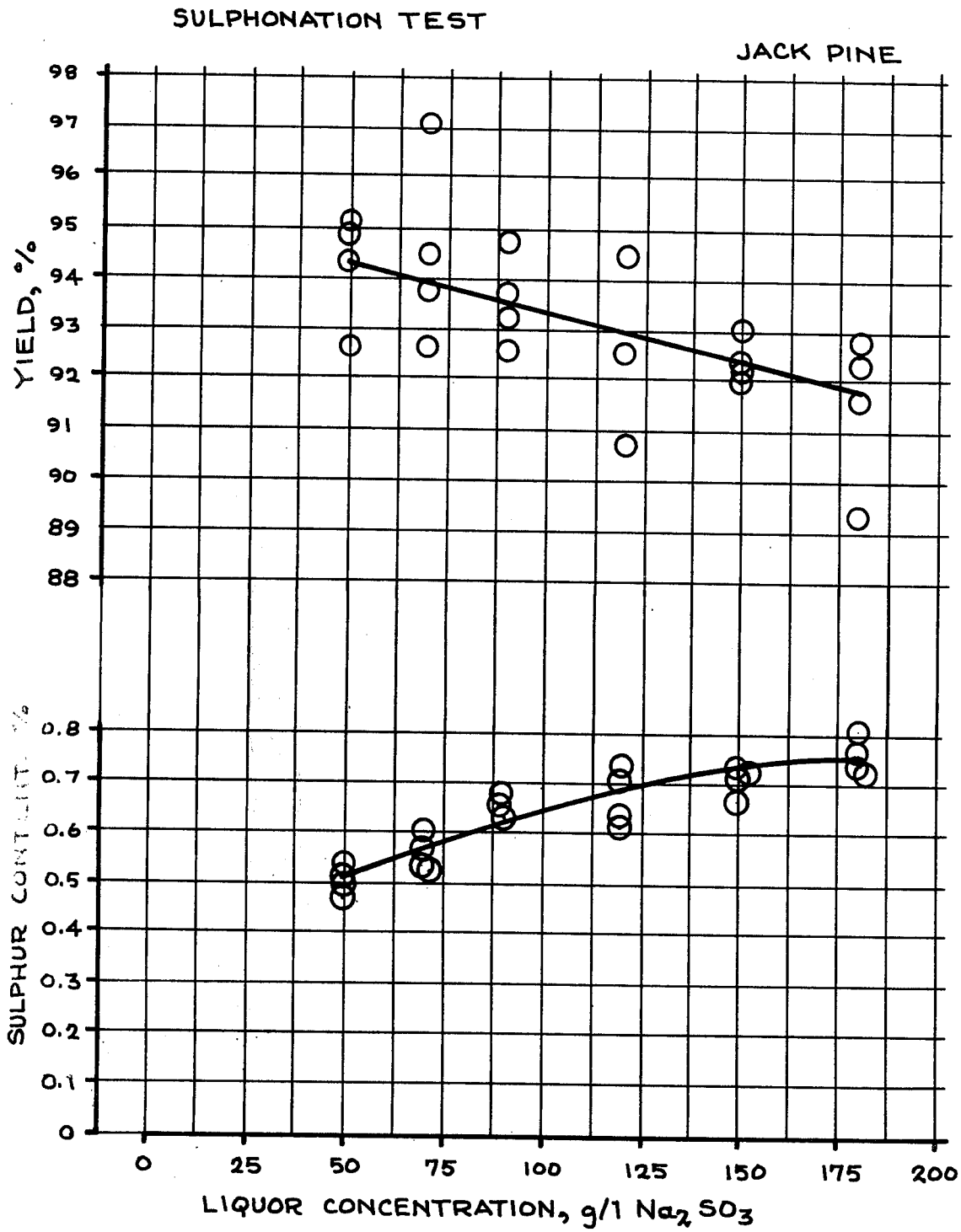
Figure 5:
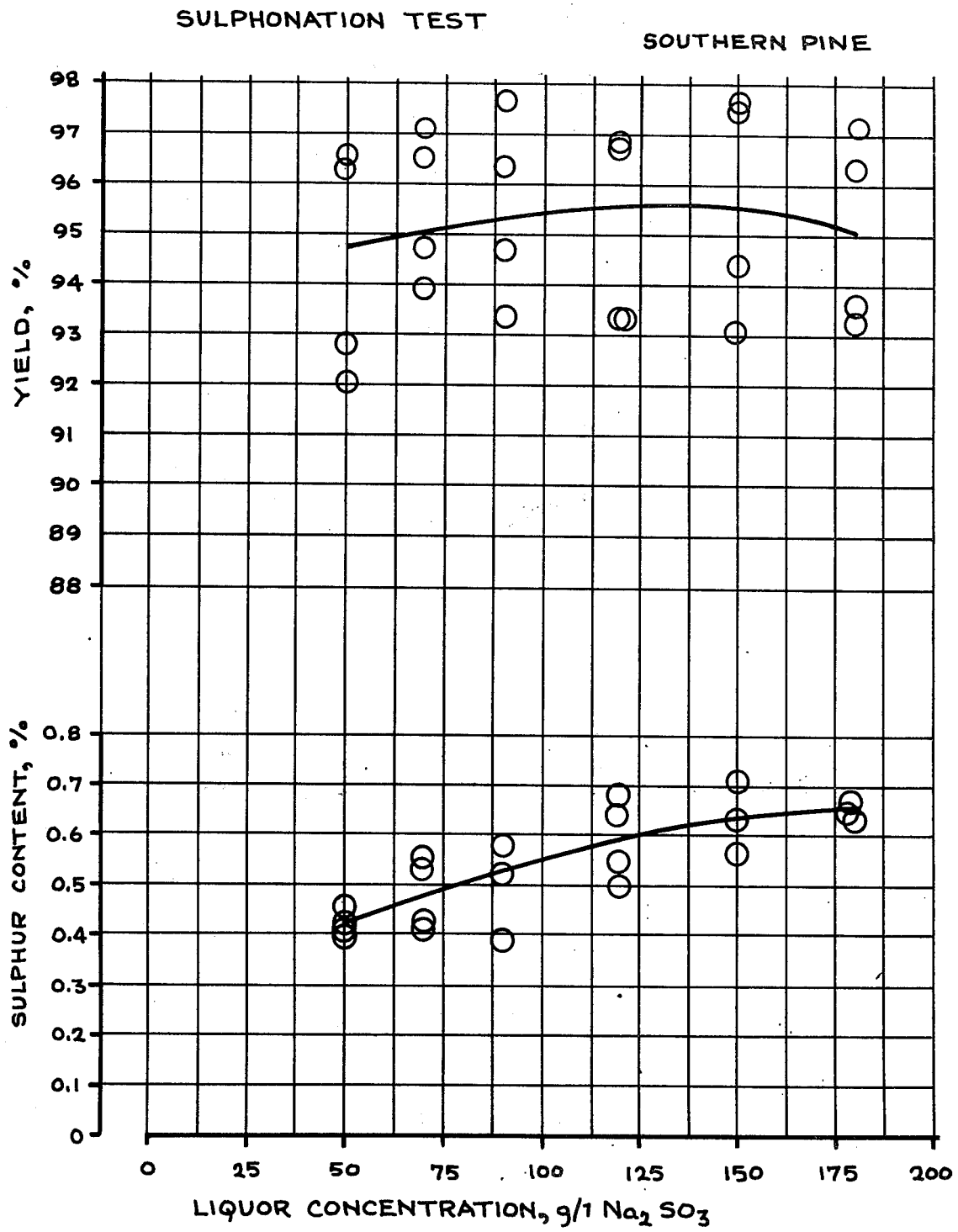
Figure 6:
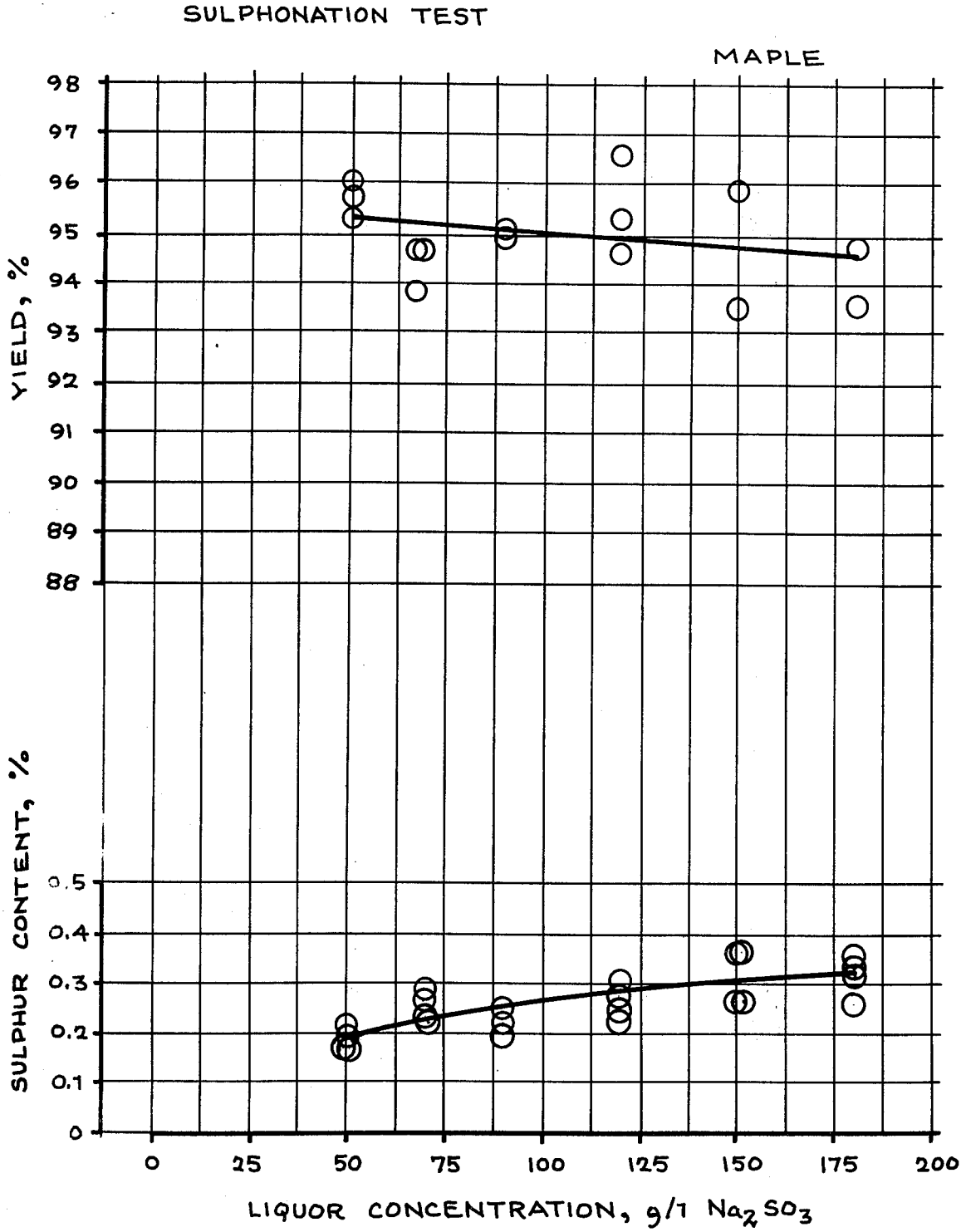
Figure 7:
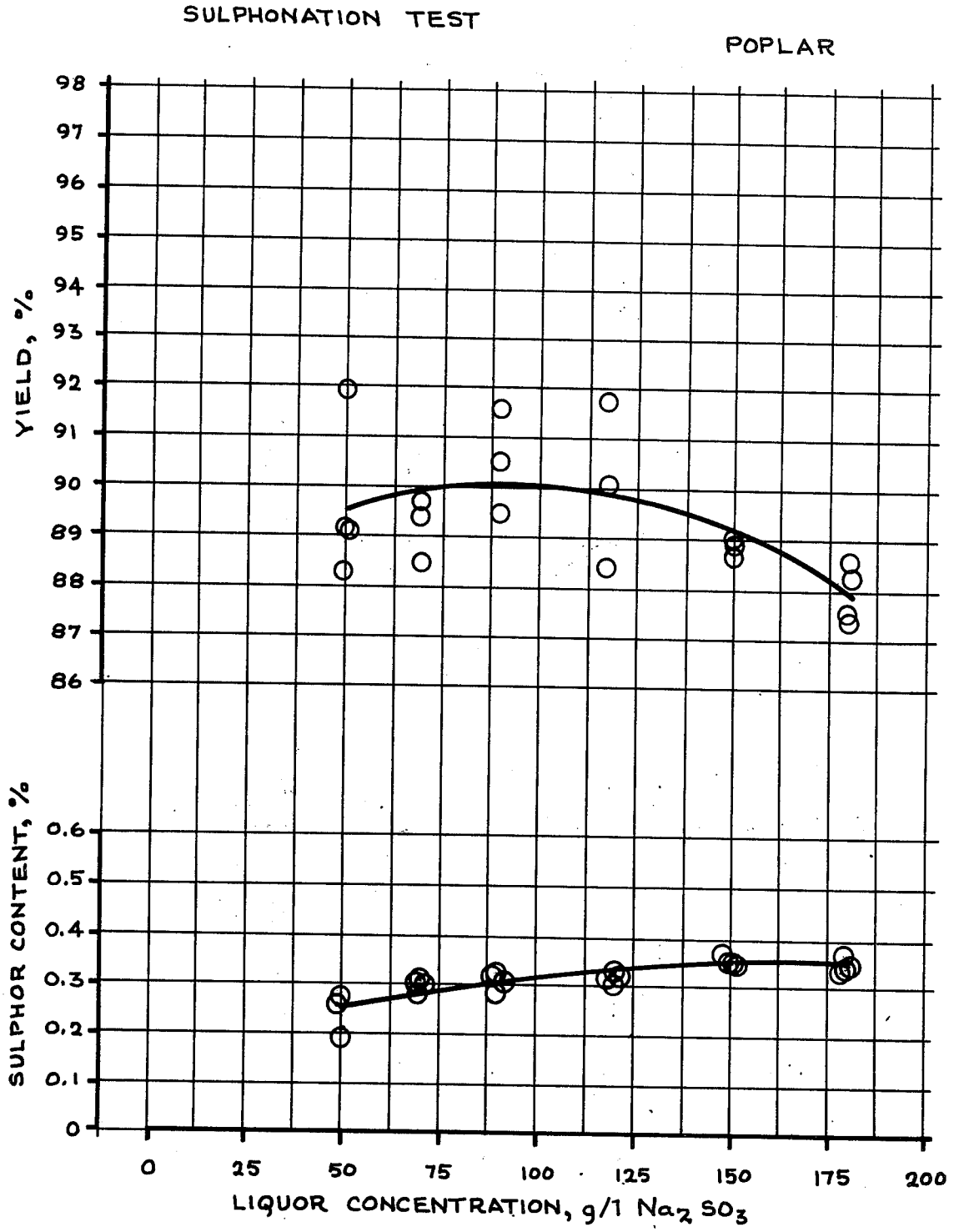
Figure 8:
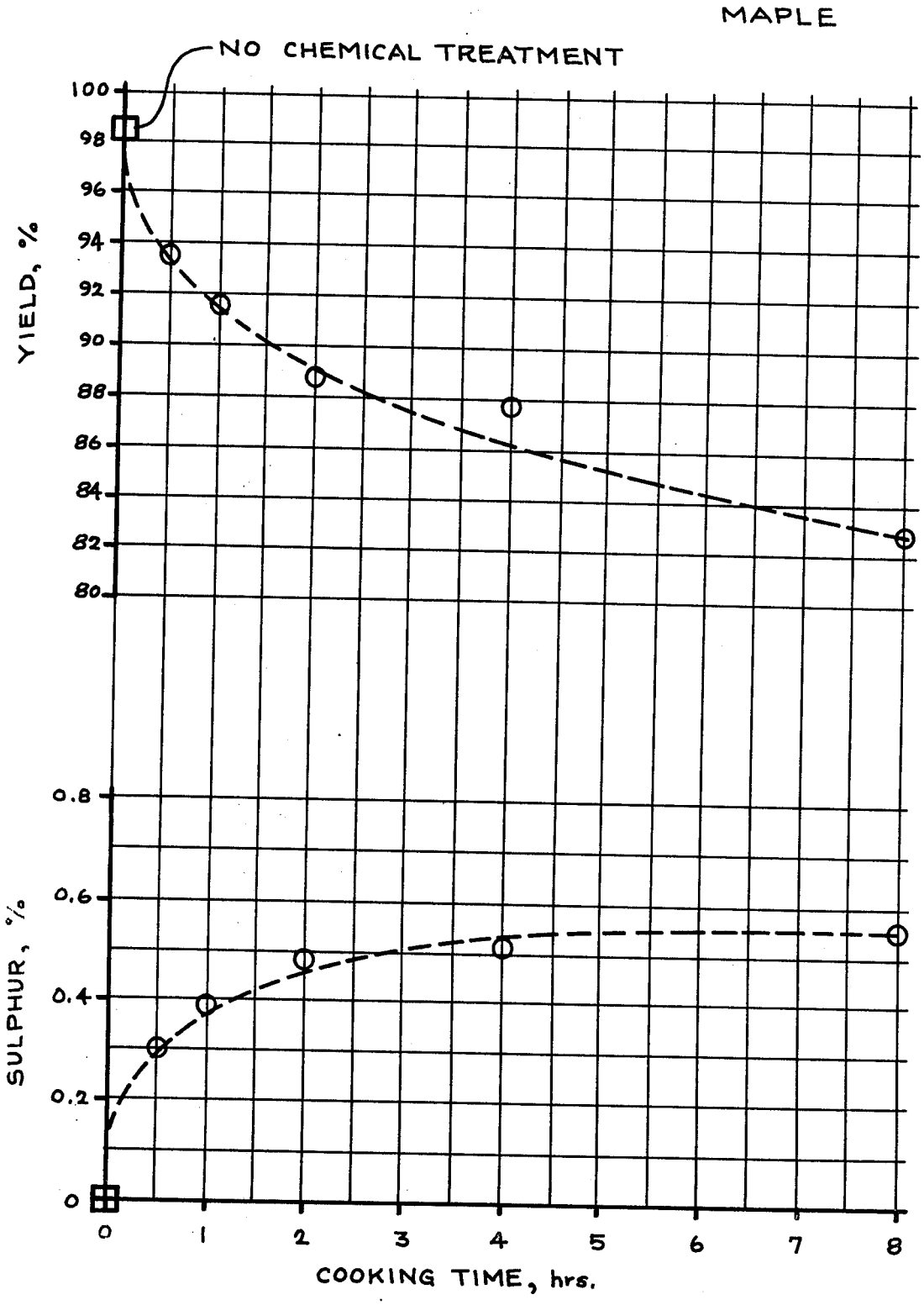

FIGS. 2 through 7 are graphs of % yield of pulp and sulfur content of the pulp vs. liquor concentration (grams per liter) of $Na_2SO_3$ for a series of six woods, as follows:

FIG. 2 — Spruce
FIG. 3 — Balsam
FIG. 4 — Jack pine
FIG. 5 — Southern pine
FIG. 6 — Maple
FIG. 7 — Poplar FIG. 8 is a graph showing the relationship of pulp yield and sulfur content for maple wood chips carried out under identical conditions for various time periods as in Example 16, infra.

GENERAL DESCRIPTION OF THE INVENTION

In the process of the present invention, the wood is sulfonated to at least about 85% (0.55% sulfur for spruce) and preferably to about 90% or more (0.58% sulfur for spruce) of the maximum level of sulfonation for that wood as described, infra. This level of sulfonation permits the wood chips to be readily mechanically defibered into individual fibers which have a flexibility more similar to low yield chemical pulp fibers than to conventional 90%-plus yield chemimechanical fibers. Indeed, we have discovered that in accordance with the present invention, the higher the degree of sulfonation of the pulp, the greater the strength properties of the pulp. This increase in strength improves dramatically with increase in sulfur content of the pulp. This effect is shown in Examples 10, 11, 12, 13, 14 and 15, infra, and Table 2, below, where the cooking liquor strength is varied from 50 g/l (grams per liter) $Na_2SO_3$ to 180 g/l $Na_2SO_3$ in a series of laboratory cooks all carried out at 140° C. for 30 minutes. The best strength levels are not reached until at least about 120 g/l $Na_2SO_3$ liquor is used, which achieves a level of sulfonation of 0.6% sulfur. Increasing the liquor strength (and hence the degree of sulfonation) beyond 120 g/l $Na_2SO_3$ does not produce substantially further strength improvements.

The conventional chemimechanical pulp made by a process reported by C. A. Richardson (Example 9) has inferior strengths compared to the pulps of Examples 13, 14 and 15 which employ the process of the present invention.

Since the nature and content of lignin in wood varies from species to species, so does the actual sulfur content that must be achieved in each case. However, in all cases the sulfonation level must always be at least about 85% and preferably about 90% or more of the maximum sulfonation that can be achieved without reducing the yield below about 90%. The following table illustrates the typical levels of sulfonation that must be achieved for a selection of commonly used wood species. These values were obtained using the test procedures for maximum level of sulfonation, infra.

| Wood Species | Maximum % S | 85% of Maximum % S |
|---|---|---|
| Spruce | 0.65 | 0.55 |
| Balsam | 0.70 | 0.60 |
| Jack Pine | 0.75 | 0.64 |
| Southern Pine | 0.65 | 0.55 |
| Poplar | 0.36 | 0.31 |
| Maple | 0.33 | 0.28 |

In order to achieve such high levels of sulfonation while maintaining yields in excess of about 90%, it is desirable to carry out the reaction at temperature not higher than 150° C. and preferably not higher than 140° C., but at least about 100° C. The preferred range is between about 120° and 140° C. These, moderate temperatures also help to maintain good brightness. In order to achieve reasonably short reaction times, e.g., 60 minutes or less, high chemical application levels are used; typically a concentration of at least 120 g/l $Na_2SO_3$ in the cooking liquor, with a cooking liquor to wood ratio of 3.3:1 [392 kg/t (kilograms per metric ton) $Na_2SO_3$ on oven dry wood]. The pH of the cooking liquor should be between about 6.0 and 8.5, preferably between about 7.2 and 8.0.

The process of the present invention is applicable to woods of all types, both hardwoods and softwood, particularly the latter.

Table 1, below, illustrates the properties of some pulps that have been made using the process of the invention. Examples of the properties of a mechanical pulp (refiner mechanical pulp, Example A) and a chemical pulp (semibleached kraft, Example B) have been included for comparison purposes.

Pulps made by this invention may be bleached by such known reagents as sodium hydrosulfite, hydrogen peroxide, or various combinations of the two. For example, a pulp (Example No. 7) with an initial brightness of 52.7 Elrepho was bleached as follows.

| Bleach Chemical | | Final Brightness |
|---|---|---|
| 1% | sodium hydrosulfite | 61.3% Elrepho |
| 1% | hydrogen peroxide | 65.7% Elrepho |
| 1% | hydrogen peroxide followed by | 69.0% Elrepho |
| 1% | sodium hydrosulfite | |

Since the attainment of the high levels of sulfonation required by the process of the invention will generally involve the use of relatively high concentrations of cooking chemicals and relatively heavy applications of cooking liquor on the wood, it is anticipated that for economic considerations in successful commercial application of the process of the invention, recycling of the unreacted sulfite from the cooked chips is desirable. This may be achieved by pressing the cooked chips to remove the liquor from them and adding fresh chemicals to the liquor to return it to its original concentration before reuse when recycled in the process. Recycling also assists in automatically controlling the liquor pH to about 7–8, a desirable value. Substantially lower pH values tend to result in lower yields.

As long as the conditions for sufficient sulfonation are adhered to, the cook can be carried out in a variety of different ways. In Example 1, below, a liquid phase process is used with no pre-impregnation with cooking liquor prior to the cook. Example 2, below, shows a liquid phase process with a 15-minute impregnation prior to the cook. In Examples 3 and 4, below, the chips were impregnated for 60 minutes prior to a vapor phase cook. In each case, the pulps produced were substantially similar in physical properties. These examples show that the process of the invention can be carried out using conventional and readily available liquid or vapor phase cooking equipment.

Example 4, below, illustrates the effect of cooking at a temperature (148° C.) somewhat higher than the optimum 140° C. While the strengths are excellent, the brightness, at 47% Elrepho, is lower than the 52–54% Elrepho that can be achieved at 140° C.

The present invention can produce good quality pulps from a wide variety of raw materials. Examples 5, 6, 7 and 8, below, show the use of southern pine, northern softwoods plus 32% poplar, 55% northern softwoods and 45% northern hardwoods, and northern softwood sawdust.

Pulp made by this invention has excellent properties over a wide freeness range (100–600 ml). This is shown in FIGS. 1*a* through 1*e*, where a number of physical properties are plotted against freeness. These regression curves were taken from over one hundred pulp samples made as in Examples 1 and 2. The ability of this pulp to perform well over such a wide freeness range, serves to distinguish it from mechanical and conventional chemimechanical pulps which, typically, are only useful at relatively low freeness levels—usually below 300 ml. In this respect, the pulp made by this invention is more comparable to low yield chemical pulps. As used in FIGS. 1*a* through 1*e* and throughout the present disclosure, freeness is referred to in terms of Canadian Standard Freeness (CSF) as defined in Tappi Standard - T 227 (M-58). Freeness is a measure of the rate at which a dilute suspension of pulp may be dewatered.

Example 16, below, shows the effect of increasing the cooking time. In this example, a very strong cooking liquor was used to illustrate the upper limit of sulfonation. Such a strong liquor could not be used in a commercial plant if liquor recycling was practiced, due to the solubility limit of $Na_2SO_3$ in spent liquor. It can be seen that the yield drops rapidly as the time is increased, and falls below 90% at about 90 minutes.

The operating pH range of this process is governed by two considerations. A pH substantially below 7.0 would be environmentally undesirable on a commercial level due to the presence of free sulfur dioxide. Due to the high concentration of the liquor, and particularly when recycled liquor is used, the pH does not drop substantially during the cook (see Example 1). Nevertheless, it is important to maintain the spent liquor no lower than about pH 6.5 so as to keep the process essentially odorless.

It is well known that in most cooking processes a pH substantially greater than about 8.0 will tend to degrade the lignin and hemicellulose and lead to reduced yield. This is shown by Example 17 (results in Table 3, below) where it can be seen that an increase in pH produced a substantial decrease in yield. It is also well known that a pH substantially above about 8.0 will tend to produce a discolored pulp which would be unacceptable in a wide range of products. Thus, this pH consideration would be significant on a commercial scale operation. In the laboratory, under carefully controlled conditions, the present process may be carried out at any pH over the about 6.0 to 8.5 range without producing odor, discolored pulp, or too low a yield. However, in a commercial plant, the control would not be as satisfactory, so that a practical minimum of above about 7.0, and preferably a pH range of from about 7.2 to 8.0 would be advisable.

Subsequent to the sulfonation of the wood chips, they are subjected to mechanical defibration by any of the conventional mechanical grinding or refining techniques. These techniques are well known to those skilled in the art of mechanical and chemimechanical pulping. One such suitable treatment is the use of double-disc refiners whereby the sulfonated chips are passed between rotating grooved discs to apply work to the chips and thereby defibrate them. The sulfonated chips may be passed through one or more refiners until the desired freeness is achieved.

TABLE 1

| | Refiner Mechanical Pulp | Semibleached Kraft Pulp | Properties of Some Typical Pulps Made by This Invention Using Commercial-Sized Equipment | | | | | |
|---|---|---|---|---|---|---|---|---|
| Example No. | A** | B*** | 1 | 4 | 5 | 6 | 7 | 8 |
| Wood Type | Northern Softwood Mixture | Northern Softwood Mixture | Northern Softwood Mixture | Northern Softwood Mixture | Southern Pine | Northern Softwoods Plus 32% Poplar | Northern Softwoods (55%) Northern Hardwoods (45%) | Northern Softwood Sawdust |
| Freeness, ml. | 100 | 550 | 300 | 260 | 327 | 300 | 320 | 300 |
| Breaking Length, m. | 3000 | 6500 | 6500 | 7900 | 4200 | 6150 | 5700 | 5100 |
| Burst Factor | 15 | 48 | 38 | 55 | 20 | 31 | 26 | 22 |
| Tear Factor | 60 | 160 | 83 | 65 | 107 | 86 | 89 | 66 |
| Bulk, $cm.^3/g.$ | 3.0 | 1.5 | 1.98 | 1.66 | 2.49 | 2.04 | 2.28 | 2.17 |
| Wet Web Strength, g./cm.* | 25 | 60 | 45 | 48 | 28 | 44 | 32 | 27 |
| % Long Fiber (> 48 mesh) | 45 | 75 | 72 | 76 | 78 | 70 | 65 | 69 |
| Brightness, % Elrepho | 56–58 | 75 | 52–54 | 47 | 50–53 | 52–55 | 49–53 | 52–54 |
| Yield, %***** | 94 | 43 | 94 | 90– | 92 91**** | 94 | 92 | 92 |

*At 20% solids, using apparatus described in U. S. Pat. No. 3,741,005, Dauth and Valters, granted June 26, 1973.
**A commercially produced Refiner Mechanical Pulp. Not made by this invention.
***A commercially produced and refined Semibleached Kraft pulp. Not made by this invention.
****Estimated
*****Obtained from separate laboratory-scale experiments, except in the cases of Examples A and B, where the results represent commercial manufacturing experience.

TABLE 2

| | Properties of Some Pulps Made in Laboratory* Equipment | | | | | | |
|---|---|---|---|---|---|---|---|
| Example No. | 19** | 10** | 11** | 12** | 13 | 14 | 15 |
| Liquor Strength, g./l. as $Na_2SO_3$ | 56 | 50 | 70 | 90 | 120 | 150 | 180 |
| Liquor pH | 6.8 | 7.8 | 7.8 | 7.8 | 7.8 | 7.8 | 7.8 |
| Cooking Time, min. | 15 | 30 | 30 | 30 | 30 | 30 | 30 |
| Cooking Temperature, ° C. | 138 | 140 | 140 | 140 | 140 | 140 | 140 |
| Freeness, ml. | 300 | 300 | 300 | 300 | 300 | 300 | 300 |
| Breaking Length, m. | 2980 | 3520 | 3870 | 3910 | 4570 | 4480 | 4590 |
| Burst Factor | 9.6 | 11.3 | 13.4 | 14.3 | 19.1 | 18.2 | 19.8 |
| Tear Factor | 77.7 | 71.4 | 70.5 | 78.4 | 79.3 | 77.6 | 80.2 |
| Bulk, $cm.^3/g.$ | 3.12 | 2.74 | 2.55 | 2.58 | 2.47 | 2.47 | 2.40 |
| Wet Web Strength, g./cm. | 17.6 | 15.4 | 17.2 | 19.5 | 23.0 | 18.8 | 18.5. |
| Brightness, % Elrepho | 52.6 | 52.8 | 53.8 | 52.4 | 52.9 | 51.8 | 52.6 |
| Yield, % | 93.9 | 92.1 | 92.2 | 92.3 | 93.9 | 94.6 | 94.1 |
| Combined sulfur, % | 0.38 | 0.45 | 0.52 | 0.56 | 0.60 | 0.62 | 0.66 |
| % Maximum Sulfonation*** | 55.4 | 64.7 | 75.7 | 80.9 | 86.8 | 89.4 | 95.8 |

*The strength properties of pulps refined in laboratory-sized refiners are, typically, not as strong as pulps refined in full-sized refiners, so strength results in this table should not be compared with those in Table 1.

**Example 9 sulfonation conditions taken from C. A. Richardson, Tappi, December 1962, Vol. 45, No. 12, p. 141A. Examples 10, 11 and 12 are comparative control examples to show effect of strength of sulfite solution.

***In all examples, the maximum combined sulfur content for the sulfonation of the wood source (the same source being used in all examples) was 0.69% sulfur.

TABLE 3

| The Effect of pH; from Example 17, below. | | |
|---|---|---|
| pH | % Yield | % Sulfur |
| 6.0 | 94.27 | 0.662 |
| 7.0 | 93.01 | 0.585 |
| 8.0 | 92.26 | 0.521 |
| 9.0 | 90.97 | 0.670 |

The pulps made from this invention are useful in such products as newsprint, coated papers, book papers, sanitary tissues, corrugating medium, linerboard, paper toweling, diaper fluff, milk carton board, etc.

SPECIFIC DESCRIPTION OF THE INVENTION

In order to disclose more clearly the nature of the present invention, the following examples illustrating the invention are given. It should be understood, however, that this is done solely by way of example and is intended neither to delineate the scope of the invention nor limit the ambit of the appended claims. In the examples which follow, and throughout the specification, the quantities of material are expressed in terms of parts by weight, unless otherwise specified.

In Example 1, below, the wood chips were digested in a continuous (3-tube Bauer M and D) digester. This type of digester is described in *Paper Trade Journal,* pages 36–37, (Sept. 5, 1960) in an article by Van Derveer, entitled "Unique New Continuous Digesters Improve Operations at Two Mills"; also *Pulp and Paper International,* May 1971, pages 55 and 56. The chips pass through the tubes of the continuous digester by means of a conveyor.

In Example 1 the refiner employed on the chips after sulfonation was a double-disc refiner manufactured by Bauer Bros. (now C-E Bauer) known as Model 400. This double-disc refiner employs 36 inch diameter grooved discs and two 110 kilowatt (150 horsepower) motors. Type 36161 plates were used in the first stage, and 36106 or 36104 plates were employed in the second stage of the refiner. The feed rate through the refiner was between two and four tons per day. In order to reach a final freeness of 400 milliliters CSF, a refiner power of about 2.5 megajoules per kilogram (35.2 horsepower days per air-dried ton) was applied in the first stage of the refiner and 2.2 megajoules per kilogram (31.0 horsepower days per air-dried ton) in the second.

Examples 9 through 15, inclusive, represent a series of controlled experiments which demonstrate a comparison of the results obtained by the prior art (Example 9) and a series of experiments with all conditions the same except that the concentration of the $Na_2SO_3$ in the digestion liquor is gradually increased (Examples 10 through 15, inclusive). In all of Examples 9–15, the same source of wood chips was employed. As demonstrated by Examples 10–15, at the temperature and cooking time conditions employed, it is not until the liquor strength is increased to about 120 g/1 $Na_2SO_3$ that the desired at least about 85% of maximum sulfonation is achieved.

EXAMPLE 1

The following method was used to produce pulp at the rate of about 4 tons per day in a pulping pilot plant.

A mixture of northern softwood chips containing approximately 42% black and white spruce, 35% balsam fir, and 23% jack pine was presteamed for about 10 minutes, then metered into a 3-tube M and D continuous digester along with cooking liquor at a liquor to wood ratio of 3.3:1 (wt./wt. of dry chips). The cooking liquor was initially prepared by mixing sodium hydroxide and sulfur dioxide in a tank to produce a concentration of 120 g/1 as $Na_2SO_3$ at a pH of 7.8. As the run progressed, spent liquor, still containing some unreacted sodium sulfite, was extracted from the last quadrant of the M and D tube, fortified with additional sodium hydroxide and sulfur dioxide or readjust the original liquor concentrations, and reused. During the course of the run (several weeks) the liquor concentration varied from about 115 g/1 to about 125 g/1 as $Na_2SO_3$ and the pH varied from about 7.5 to about 8.0. The pH of the spent liquor covered the range 7.0 to 7.4.

The liquor in each of the three tubes in the digester was maintained at a temperature of 135° C. (range 132°–138° C.) at a pressure of 410 kPa (range of from 400 to 500 kPa) (kPa refers to kilopascals). The residence time of chips in the digester was 30 minutes (10 minutes per tube).

The cooked chips were discharged from the digester into a blow tank at atmospheric pressure, then transferred to a double-disc refiner. Sufficient water was added to the chips just before entering the refiner to reduce the consistency to about 15%. The pulp leaving the refiner had a freeness range of 650–720 ml, typically.

The pulp was diluted to about 2% consistency and pumped to a horizontal belt washer where it was washed with hot water to remove residual cooking chemicals and waste products. The pulp left the washer at a consistency of about 15% and was fed to a second double-disc refiner, at that consistency, where the freeness was reduced to about 350 ml.

After leaving the second refiner, the pulp was diluted to about 2% consistency and heated by direct steam injection to at least 75° C. (not exceeding 100° C.) and held above 75° C. for at least 20 minutes, for latency removal. The pulp was then further diluted to about 0.8% and passed through a pressure screen (Centriscreen) and centrifugal cleaners before being thickened on a lap machine to about 25% consistency.

The properties of a typical pulp made in this manner are shown in Table 1, supra.

A quantity of this pulp was conveyed to a newsprint manufacturing mill, slurried with water and mixed with other pulps in the following proportion:

25% pulp of this example
2% refined semibleached kraft
45% stone groundwood
28% refiner mechanical pulp This mixture was run over a fourdrinier paper machine (with vacuum pickup) and converted into newsprint with basis weight averaging 48.8 g/m$^2$. Operation of the machine was normal compared to operating using a conventional pulp mixture containing 18% semibleached kraft except that drainage at the wet end was a little faster than normal. The newsprint was subsequently printed at the printing plant of a large metropolitan newspaper with excellent results.

EXAMPLE 2

This example is substantially similar to Example 1, except that the chips were allowed to impregnate in the first tube of the M and D digester for 15 minutes at a temperature of about 75° C., followed by a 30-minute cook (15 minutes in each of the next two tubes) at about 135° C. The pulp produced by this technique was substantially similar to that made in Example 1. This pulp was also used for newsprint production trials as in Example 1 and with substantially similar results.

EXAMPLE 3

This example is similar to Example 2 except that the chips were impregnated in the first tube for 60 minutes at 345 kPa using sodium sulfite, bisulfite liquor with a concentration of 154 g/1 (as $Na_2SO_3$), and that liquor was removed from the last quadrant of the impregnating tube of the digester at a sufficient rate so as to prevent liquor from overflowing into the second tube. The chips, which entered the second tube substantially free of surface liquor were cooked at a temperature of 132° C. for 30 minutes using direct injection of steam to a pressure of 240 kPa. The pulp had properties similar to those of Example 1.

EXAMPLE 4

Example 3 was repeated, except that the chips were impregnated with 156 g/1 liquor then cooked at a temperature of 148° C. using a pressure of 327 kPa. This pulp has properties as shown in Table 1, supra.

EXAMPLE 5

Example 2 was repeated, except that southern pine chips were used. This pulp had properties as shown in Table 1, supra.

EXAMPLE 6

Example 2 was repeated, except that the chips had the following average composition:

Red Spruce, 32.9%
Balsam Fir, 9.5%
Red Pine, 15.9%
White Pine, 9.7%
Poplar, 32.0%

The pulp produced had the properties shown in Table 1, supra. Approximately 17 tons were made and shipped to a paper mill where the pulp was slurried and bleached using 1.5% sodium hydrosulfite and 0.25% sodium tripolyphosphate, to a final brightness of 58.8 to 61.0 (average 59.3) G. E. The pulp was then blended with other pulps in the following proportions:

35% pulp of this example
35% bleached, refined, softwood kraft
30% stone groundwood This mixture was converted into 65 g/m$^2$ (grams per square meter) coated publication grade paper (base sheet weight 40.7 g/m$^2$) using a fourdrinier paper machine with two on-machine coaters (approximately 12.2 g/m$^2$ of clay coating per side being applied). The sheet was supercalendered. All phases of the manufacturing process were normal compared to operation with the normal furnish of 52% bleached, refined softwood kraft and 48% stone groundwood, and the sheet performed well on commercial printing presses.

EXAMPLE 7

Example 1 was repeated, except that a mixture of northern softwoods and hardwoods with the following approximate composition was used:

Spruce 34.8%
Balsam 12.5%
Red and White Pine 8.3%
Poplar 19.8%
Beech 5.1%
Maple 10.0%
Ash 3.6%
Elm 5.2%
Basswood 0.8%

Sufficient quantities for small scale investigations only were made. The pulp had the properties shown in Table 1, supra.

EXAMPLE 8

Example 2 was repeated, except that mixed northern softwood sawdust was used and the liquor heating was substantially supplemented by direct steam. All spent liquor was allowed to discharge into the blow tank with the cooked sawdust. Sufficient quantities only for small scale investigations were made. The pulp had properties shown in Table 1, supra.

EXAMPLE 9

This is a comparative example illustrating the prior art.

800 g. (dry basis) of a mixture of northern softwood chips containing approximately 42% black and white spruce, 35% balsam fir, and 23% jack pine were placed in a 10-liter laboratory digester to which was added 6 liters of a liquor consisting of a sodium sulfite/bisulfite solution with a concentration of 56 g/l as $Na_2SO_3$, and had a pH of 6.8. The digester and contents were heated, using indirect steam, to a temperature of 138° C., pressurized to 585 kPa with nitrogen and held there for 15 minutes. After the cook, the chips were drained and defibered into pulp using three passes through a 50 HP, 12-inch diameter, Sprout Waldron laboratory refiner using consistencies of about 15%. The pulp was screened through a 0.0152 cm. slotted screen, then given a 30-minute, 80° C., latency treatment before testing. The pulp had properties as shown in Table 2.

These cooking conditions simulate those reported by C. A. Richardson in *Tappi*, December 1962, Vol. 45, No. 12, page 141A.

EXAMPLE 10

This is a comparative control example.

Example 9 was repeated, except that the liquor concentration was 50 g/l as $Na_2SO_3$ at a pH of 7.8, and the cooking conditions were 140° C. for 30 minutes, at self-generated pressure only.

The pulp had properties as shown in Table 2.

EXAMPLE 11

This is a comparative control example.

Example 10 was repeated, except that the liquor concentration was 70 g/l as $Na_2SO_3$.

The pulp had properties as shown in Table 2.

EXAMPLE 12

This is a comparative control example.

Example 10 was repeated, except that the liquor concentration was 90 g/l as $Na_2SO_3$.

The pulp had properties as shown in Table 2.

EXAMPLE 13

Example 10 was repeated, except that the liquor concentration was 120 g/l as $Na_2SO_3$.

The pulp had properties as shown in Table 2.

EXAMPLE 14

Example 10 was repeated, except that the liquor concentration was 150 g/l as $Na_2SO_3$.

The pulp had properties as shown in Table 2.

EXAMPLE 15

Example 10 was repeated, except that the liquor concentration was 180 g/l as $Na_2SO_3$.

The pulp had properties as shown in Table 2.

EXAMPLE 16

Maple chips were cooked in small bombs using a technique substantially similar to that described in the sulfonation test except that the cooking liquor strength was held constant at 200 g/l $Na_2SO_3$ and a series of cooks were carried out at various times between 30 minutes and 8 hours.

The results are plotted in FIG. 8 of the drawings.

EXAMPLE 17

Mixed softwood chips similar to those used in Example 1 were cooked in small bombs using a technique substantially similar to that described in the sulfonation test except that the cooking liquor strength was held constant at 120 g/l and the pH was varied from 6.0 to 9.0.

The results are set forth in Table 3, supra.

TEST PROCEDURE FOR DETERMINING THE MAXIMUM LEVEL OF SULFONATION THAT CAN BE ACHIEVED FOR VARIOUS WOOD SPECIES 2 kg. (dry basis) of screened wood chips are carefully mixed and 1 kg. is removed and dried to provide an accurate moisture determination. The balance is divided into 100 g. (wet basis) aliquots and each is carefully weighed. Each aliquot of chips is placed in a small bomb (capacity 540 ml.) to which is added sufficient sodium sulfite/bisulfite liquor to just cover the chips. A series of liquors are used, each being prepared by adding gaseous $SO_2$ to a solution of sodium sulfite to reduce the pH to 7.8. The liquors have the following concentrations: (w/v as $Na_2SO_3$) 50, 70, 90, 120, 150, and 180 g/l. At least two cooks are carried out at each liquor strength. The bombs are sealed and placed in an oil bath which has been heated to 140° C. The bombs are mounted on a rotating device that upends the bombs 2 or 3 times per minute in order to provide some agitation to the mixture of chips and liquor. The bombs are removed after 30 minutes.

When each bomb is removed from the oil bath, it is immediately plunged into cold water to produce rapid cooling. The cooked chips are removed from the bomb as soon as possible, the liquor is drained off and discarded, and the chips are defibered in cold water using an industrial blender (Waring or Osterizer type) for 15 minutes or until the chips are well defibered. The pulp is then filtered, on a filter paper, carefully washed with a large volume of cold water, then dried in an oven and weighed and the yield calculated. After weighing, a sample of pulp is taken and its sulfur content is determined.

The yield and sulfur content data are plotted against liquor strength as illustrated in FIGS. 2 to 7 of the drawings. These graphs show the customary scatter of data points, regression curves were calculated in order to show the trend. For many species the sulfur content will tend to reach a maximum (or plateau) at 15–18% $Na_2SO_3$, and usually this maximum will be reached without reducing the yield below 90%. In the case of softwoods (FIGS. 2 to 5) it is probable that the sulfur content could be increased a little beyond that reached at 18% $Na_2SO_3$ liquor, but higher liquor concentrations are not practical, particularly when recycled liquors are used due to the solubility limit of $Na_2SO_3$ in the presence of dissolved organic materials.

Higher sulfur levels can always be achieved by increasing time or temperature; however, this will usually lead to yields below 90%.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. A method for production of high yield chemimechanical pulp from woody lignocellulosic material which comprises treating said woody lignocellulosic material with an aqueous solution of a mixture of sulfite and bisulfite having a pH of between about 6.0 and 8.5 at a temperature of between about 100° C. and 150° C. for a period of between about 10 and 90 minutes, said aqueous solution being of sufficient strength to sulfonate said woody lignocellulosic material to at least about 85% of the maximum level of sulfonation that can be achieved on said woody lignocellulosic material without reducing the yield of pulp below about 90% by weight, and subsequently subjecting the resulting sulfonated material to mechanical defibration.

2. A method according to claim 1, wherein the aqueous solution is of sodium sulfite and sodium bisulfite.

3. A method according to claim 1, wherein the pH is between about 7 and 8.

4. A method according to claim 1, wherein the pH is between about 7.2 and 8.0.

5. A method according to claim 1, wherein the temperature is between about 120° and 140° C.

6. A method according to claim 1, wherein the period of treatment with said aqueous solution is between about 20 and 60 minutes.

7. A method according to claim 1, wherein the woody lignocellulosic material is sulfonated to at least about 90% of the maximum level of sulfonation that can be achieved on said material without reducing the yield of pulp below about 90% by weight.

8. A method according to claim 1, woody lignocellulosic material is wood chips.

9. A method according to claim 1, wherein woody lignocellulosic material is sawdust.

10. A method according to claim 1, wherein the sulfonated woody lignocellulosic material is pressed prior to mechanical defibration to remove spent aqueous solution and the spent aqueous solution is then adjusted to initial strength with regard to concentration of sulfite and bisulfite and is recycled and used to treat fresh material.

11. A method according to claim 10, wherein the pressing of said sulfonated woody lignocellulosic material produces a controlled volume of spent aqueous solution, said volume being substantially equal to that which, after refortification with fresh sulfite and bisulfite, is applied to fresh woody lignocellulosic material to provide a system in which there is no excess flow of used aqueous solution.

* * * * *

UNITED STATES PATENT AND TRADEMARK OFFICE

CERTIFICATE OF CORRECTION

PATENT NO. : 4,116,758

DATED : September 26, 1978

INVENTOR(S) : Michael J. Ford and Prescott Elliott Gardner

It is certified that error appears in the above-identified patent and that said Letters Patent are hereby corrected as shown below:

Title page, right-hand column, line 5, "p962" should read -- 1962 --.

Col. 3, line 12, "and" should read -- through --.

Col. 3, line 16, insert after "(FIG. 1a)," the word -- burst --.

Col. 4, line 32, "softwood" should read -- softwoods --.

In Table 1, columns 5 and 6:

First column, last line, after "Yield,%*****" delete -- 94 --.

Second column, last line, "43" should read -- 94 --.

Third column, last line, "94" should read -- 43 --.

UNITED STATES PATENT AND TRADEMARK OFFICE

CERTIFICATE OF CORRECTION

PATENT NO. : 4,116,758

DATED : September 26, 1978

INVENTOR(S) : Michael J. Ford and Prescott Elliott Gardner

It is certified that error appears in the above-identified patent and that said Letters Patent are hereby corrected as shown below:

Fourth column, last line, "90-" should read -- 94 --.

Fifth column, last line, "92 91** " should read -- 90-91** --.

Sixth column, last line, "94" should read -- 92 --.

Seventh column, last line, "92" should read -- 94 --.

Ninth column, last line, insert -- 92 --.

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*